US006012960A

United States Patent [19]

Lee

[11] Patent Number: 6,012,960

[45] Date of Patent: Jan. 11, 2000

[54] SPRINKLER TOY HANDLE PUMP

[75] Inventor: Sam Y. Lee, Torrance, Calif.

[73] Assignee: Mattel, Inc., El Segundo, Calif.

[21] Appl. No.: 09/133,904

[22] Filed: Aug. 13, 1998

[51] Int. Cl.[7] ..... A63H 3/28

[52] U.S. Cl. ..... 446/185; 446/180; 446/197

[58] Field of Search ..... 446/3, 71, 72, 446/73, 74, 153, 156, 159, 166, 167, 180, 185, 197, 198

[56] References Cited

U.S. PATENT DOCUMENTS

| | | | |
|---|---|---|---|
| 2,681,656 | 6/1954 | Starkenberg | 446/197 |
| 2,758,418 | 8/1956 | Troppe | 446/197 |
| 2,811,808 | 11/1957 | Briese . | |
| 3,285,584 | 11/1966 | Goldfarb | 446/197 |
| 3,570,765 | 3/1971 | De Gast | 446/197 |
| 4,205,785 | 6/1980 | Stanley . | |
| 4,235,378 | 11/1980 | Melin et al. . | |
| 4,496,329 | 1/1985 | Kubiatowicz . | |
| 4,689,032 | 8/1987 | Trossman | 446/153 X |
| 4,923,429 | 5/1990 | Lewis | 446/156 X |
| 4,990,118 | 2/1991 | Shiina | 446/197 |
| 5,017,171 | 5/1991 | Shiina | 446/197 |
| 5,098,111 | 3/1992 | Kashimoto | 446/197 X |
| 5,213,540 | 5/1993 | Yang . | |
| 5,403,018 | 4/1995 | Sejnowski et al. . | |
| 5,421,764 | 6/1995 | Namiki | 446/197 |
| 5,522,755 | 6/1996 | Farrell et al. | 446/153 |

*Primary Examiner*—Sam Rimell
*Attorney, Agent, or Firm*—Roy A. Ekstrand

[57] ABSTRACT

A generally cylindrical base defines a bottom supporting surface securable by suction cup attachment to a table top or the like. The base defines an interior reservoir and is hingedly joined to a pivotable cover. The cover supports a rotating element and an upwardly directed spray nozzle. A generally U-shaped handle is pivotally secured to the base and is operatively coupled to an internal pump mechanism which forces water upwardly through the spray nozzle and a drive mechanism which rotates the rotatable element.

8 Claims, 3 Drawing Sheets

10
11
12
13
14
15
16
20
21
22
30
31
32
33
34
35
36
37
38
40
3
4

SPRINKLER TOY HANDLE PUMP

FIELD OF THE INVENTION

This invention relates generally to water-play toys and particularly to water-play toys having a fountain or sprinkler feature.

BACKGROUND OF THE INVENTION

Water play toys are well known in the art and have been fabricated by practitioners of the toy arts for many years. Such toys typically employ a plurality of moving parts through which or upon which various water transfers such as spraying or shooting streams of water take place. The majority of such water play toys are intended for use outdoors and employ a source of water under pressure such as a conventional garden hose or the like. Often mechanical apparatus are driven by water flow from the hose through the toy to provide amusing and entertaining activities.

Other types of water play toys are suitable for operation indoors as well as outdoors or in areas such as a bathtub or the like. Such water play toys usually provide a closed system or water reservoir together with one or more pumps and other apparatus for pushing water through the toy and for returning the water to be collected in the reservoir. For example, U.S. Pat. No. 2,758,418 issued to Troppe sets forth a WHEELED PULL-TOY having a body supported upon a plurality of wheels configured to replicate a truck vehicle or the like. A windup motor power source is operatively coupled to a rotating umbrella-like spray device. A water reservoir situated within the truck cooperates with a hand-held resilient bulb coupled to the spray apparatus within the umbrella. As the user pulls the toy vehicle, the windup motor drives the umbrella through rotation and the user's squeezing and releasing of the hand-held bulb sprays water upwardly about the umbrella.

U.S. Pat. No. 4,205,785 issued to Stanley sets forth a WATER PLAY TOY WITH ELEVATABLE CLOWN PORTION having a base configured to replicate a clown's head and an interior fitting for receiving one end of a garden hose. The garden hose is coupled through the clown's head to a nozzle supported on top of the clown's head. A generally conical clown's hat is rested upon the top of the clown's head and receives the water spray to produce a raised and levitated hat as the water maintains the hat above the clown's head.

U.S. Pat. No. 4,235,378 issued to Melin et al sets forth a WATER PLAY TOY having a cartoon-like figure which includes an internal hose fitting suitable for coupling to a garden hose and an upper discharge mechanism coupled to the water source. The discharge mechanism forms a convex surface having a plurality of apertures therein, each of which is coupled to a discharge tube having a random shape and length. Water drives through the coupling within the figure and outwardly in various directions from the tubes.

U.S. Pat. No. 4,496,329 issued to Kubiatowicz sets forth a WATER JET TOY having a water reservoir coupled to a source of water under pressure such as a garden hose. Within the water reservoir an upwardly directed nozzle provides an upward jet of water which supports a buoyant ball in a raised hovering position above the toy.

U.S. Pat. No. 5,403,081 issued to Sejnowski et al sets forth a WATER TOY having a basket for receiving a ball therein and a water mechanism for ejecting the ball from the basket. The water mechanism is operative in a first position for emitting a fine spray of water and in a second position for emitting an upwardly directed high pressure stream of water which ejects the ball from the basket.

U.S. Pat. No. 5,098,111 issued to Kashimoto sets forth an ORNAMENTAL GAME WITH UNDERWATER MOVING MECHANISM having a transparent water tank supporting a plurality of moving neutrally buoyant articles within a water immersion. A bellows pump is operative by the user to provide a water jet into the tank which tends to raise some of the buoyant articles and allow them to descend slowly through the liquid among a plurality of targets.

U.S. Pat. No. 5,213,540 issued to Yang sets forth a WAVE GENERATING AQUATIC TOY DEVICE having a water reservoir supported in a tiltable manner upon a base. The reservoir is filled with liquid and supports a plurality of floatable toys. Means are provided within the base for rocking the water reservoir to produce waves in the liquid which in turn bounce the buoyant articles.

U.S. Pat. No. 2,811,808 issued to Briese sets forth a DRINKING TUBE having a vertical pipe defining a closed end and having a piston supported within the closed end. A piston rod extends from the piston upwardly through a sealed aperture in the closed end and supports a figure such as a toy bird or the like. The pipe further supports an additional pipe communicating with the interior of the vertical pipe. When the piston is at the lowest point in its travel due to reduced or nonexistent water pressure within the vertical tube, the piston closes the diverting pipe. Once pressure is applied, however, the piston is raised and water then flows outwardly through the diverting pipe.

Thus while the foregoing prior art devices have improved the art, and in some instances enjoyed commercial success, there remains nonetheless a continuing need in the art for evermore improved, amusing and entertaining water play toys.

SUMMARY OF THE INVENTION

Accordingly, it is a general object of the present invention to provide an improved sprinkler toy. It is a more particular object of the present invention to provide an improved sprinkler toy which does not require coupling to a pressurized water source or the like. It is a still further object of the present invention to provide an improved sprinkler toy which operates without battery powered pump apparatus and which is suitable for use indoors in bathtubs or the like.

In accordance with the present invention, there is provided a sprinkler toy comprising: a base defining a reservoir, for holding a quantity of liquid, and an upper rim, a handle pivotally supported upon the base, the handle being pivotable from one side of the base to the other, a cover receivable by the rim having a rotatable element and an upwardly directed nozzle, a pump having a liquid input within the reservoir, an output, and means coupling the output to the nozzle, cam means coupled to the handle and pivoting with the handle, a pump drive operative in response to the cam means operating the pump as the handle is pivoted, and drive means, coupling the handle to the rotatable element, the drive means converting bidirectional pivotal motion of the handle to a single direction rotation of the rotatable element.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figures 1, 2:
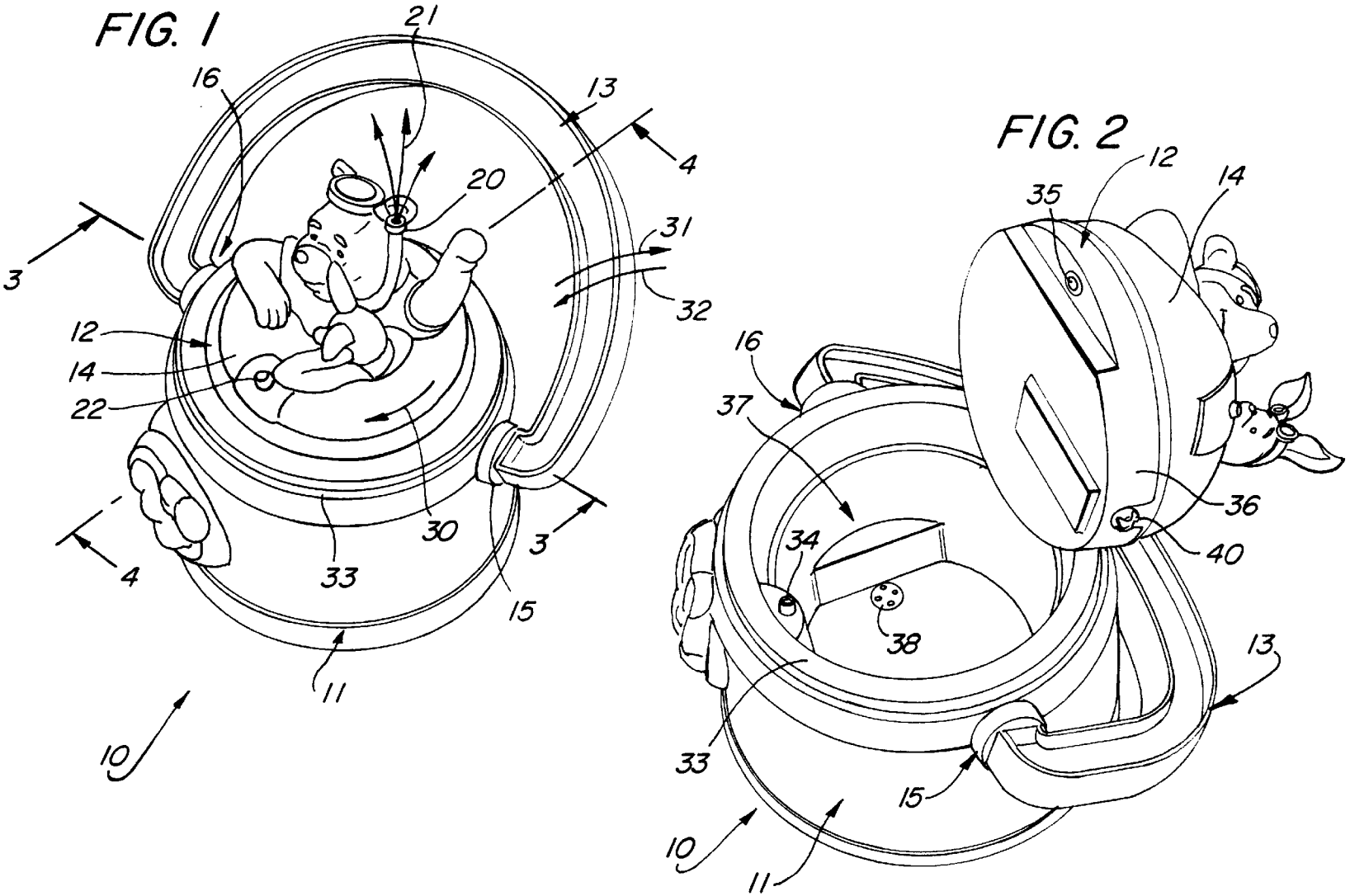
FIG. 1 sets forth a perspective view of a sprinkler toy constructed in accordance with the present invention in its operative position.
FIG. 2 sets forth a perspective view of the present invention sprinkler toy in the open position suitable for replenishing the water supply.

FIG. 1 sets forth a perspective view of a sprinkler toy constructed in accordance with the present invention and generally referenced by numeral 10. Sprinkler toy 10 includes a generally cylindrical pail-like base 11 having an annular rim 33 on the upper portion thereof. Base 11 is generally cylindrical and supports a pair of handle pivots 15 and 16, the structure of which is better set forth below in FIG. 3. Toy 10 further includes a generally U-shaped handle 13 having end portions coupled to pivots 15 and 16 on either side of base 11. As is set forth below in greater detail, handle 13 is pivotally movable in the directions indicated by arrows 31 and 32 upon pivots 15 and 16. In the anticipated use of the present invention sprinkler toy, the range of pivotal motion of handle 13 is substantially the full range of motion in both directions. For purposes of illustration, FIG. 2 shows handle 13 in the maximum pivotal direction in one sense, it being understood that an opposite range of motion is provided for handle 13 in the opposite respect to base 11.

Returning to FIG. 1, sprinkler toy 10 further includes a cover generally referenced by numeral 12 having a rotating element 14 supported thereon. A latch button 22 operates a conventional latch mechanism (not shown) which latches covering 12 to rim 33 using a conventional latch mechanism. Rotating element 14 is rendered aesthetically interesting by a plurality of figures and includes an upwardly directed sprinkler nozzle 20 which in turn produces a water spray 21 when toy 10 is operated.

Figure 4:
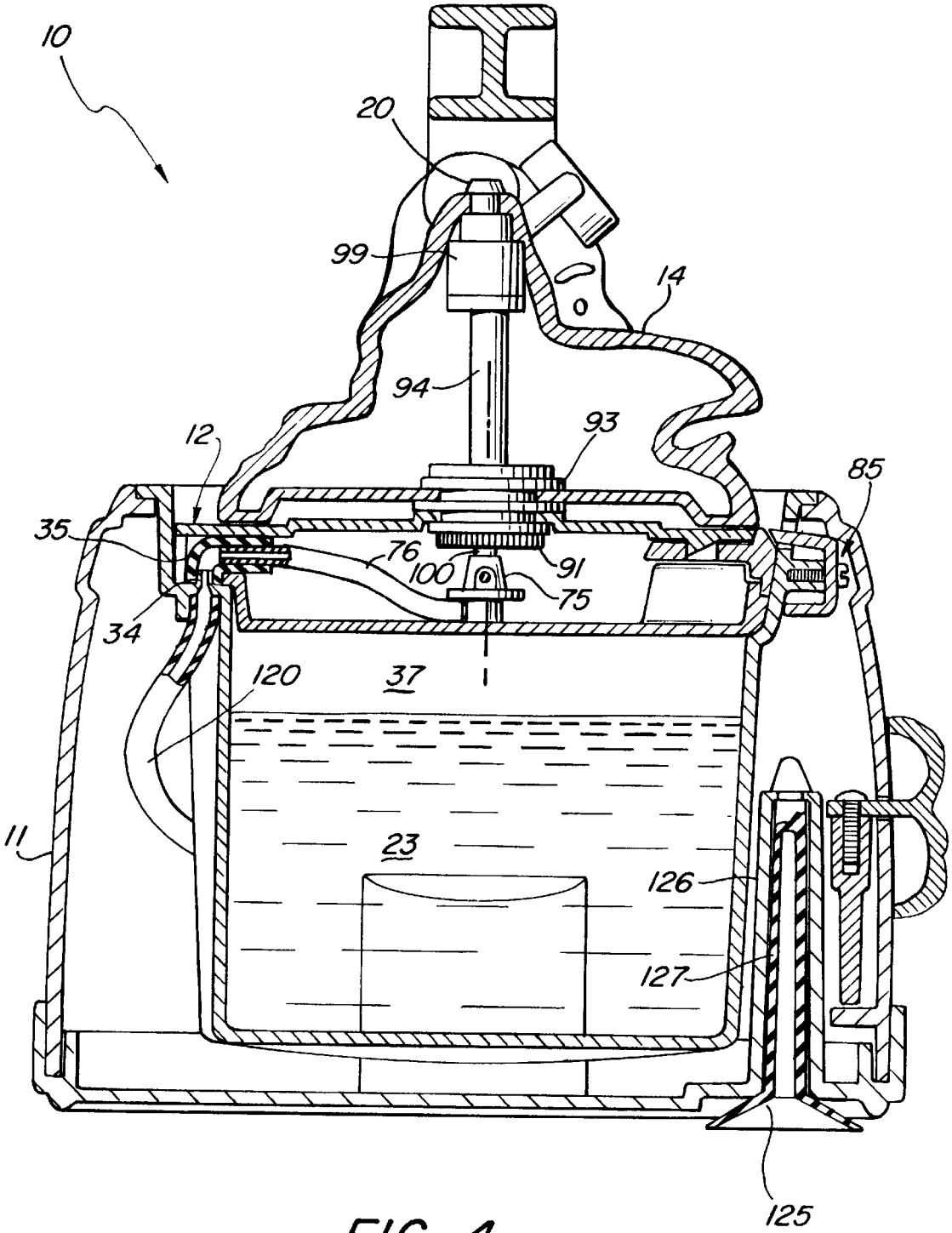
FIG. 4 sets forth a section view of the present invention sprinkler toy taken along section lines 4—4 in FIG. 1.

In operation, base 11 is situated upon a convenient flat working surface such as a table or bathtub floor using a plurality of suction cup attachment apparatus such as that shown in FIG. 4. With base 11 secured, the user pivots handle 13 about pivots 15 and 16 in the directions indicated by arrows 31 and 32 in an angular reciprocating motion.

The pump apparatus and rotational drive coupled to rotating element 14 are set forth below in FIGS. 2, 3, and 4 in greater detail. However, suffice it to note here that an interior reservoir (reservoir 37 in FIG. 2) stores a supply of water within base 11. In addition, handle 13 is operatively coupled to an internal rotational drive mechanism coupled to rotating element 14 (seen in FIG. 3) which causes rotating element 14 to revolve in the direction indicated by arrow 30. In accordance with an important aspect of the present invention, the direction of rotation of rotating element 14 continues in the direction of arrow 30 despite the "back and forth" bidirectional movement of handle 13 as the user operates toy 10. In further accordance with the present invention and as is also set forth below in greater detail in FIG. 3, the back and forth pivotal motion of handle 13 is coupled to an internal pump mechanism which is operative to force water upwardly from base 11 into cover 12 and outwardly through nozzle 20.

Thus as the child user operates toy 10, by repeatedly moving handle 13 in a pivotal motion back and forth between contact with the underlying surface on each side of base 11, rotating element 14 is continuously rotated and a plurality of water sprays 21 is directed upwardly from nozzle 20.

FIG. 2 sets forth a perspective view of sprinkler toy 10 having cover 12 in the open position which is appropriate to refilling reservoir 37. As described above, sprinkler toy 10 includes a base 11 having an upper rim 33. As is also described above, toy 10 includes a handle 13 pivotally secured to base 11 by pivots 15 and 16. A cover 12 includes a rotating element 14, a seat 36, and a spray nozzle (seen in FIG. 1).

In further accordance with the present invention, reservoir 37 within base 11 is formed to provide a liquid containing vessel allowing the user to place a quantity of liquid such as water within reservoir 37. A multiply apertured grille 38 is positioned at the lower end of reservoir 37 and as is seen in FIG. 3, is operative as the input to the internal pump (also seen in FIG. 3). An upwardly directed pump outlet 34 extends toward cover 12 and forms the high pressure output side of the internal pump.

Cover 12 includes a seat 36 received within rim 33 when cover 12 is pivoted back to the closed position of FIG. 1. When so positioned, fitting 35 is received upon pump outlet 34 in the manner indicated in FIG. 4. As is also better seen in FIG. 4, fitting 35 is coupled to nozzle 20 within rotating element 14 to complete the water output from the internal pump.

In further accordance with the present invention, cover 12 supports a drive coupler 40 having a plurality of engaging tines configured to be spring loaded within seat 36. Accordingly, as cover 12 is closed, drive coupler 40 is forced into seat 36 as seat 36 fits within rim 33. At the fully closed position and as is better seen in FIG. 3, drive coupler 40 extends outwardly and engages pivot 15.

Thus the child user is able to manipulate the present invention sprinkler toy while secured conveniently upon a flat surface and is able to observe the entertaining motion of rotating element 14 together with a spray such as spray 21 as the user pivots handle 13 back and forth. Once again it will be noted that in accordance with an important aspect of the present invention, rotating element 14 maintains a single direction of rotation despite the reciprocal back and forth pivoting of handle 13. Once the child user has depleted the water supply within toy 10, the user simply depresses latch button 22 and pivots cover 12 to the open position shown in FIG. 2. When so positioned, the child can readily replenish the water supply within reservoir 37.

Figure 3:
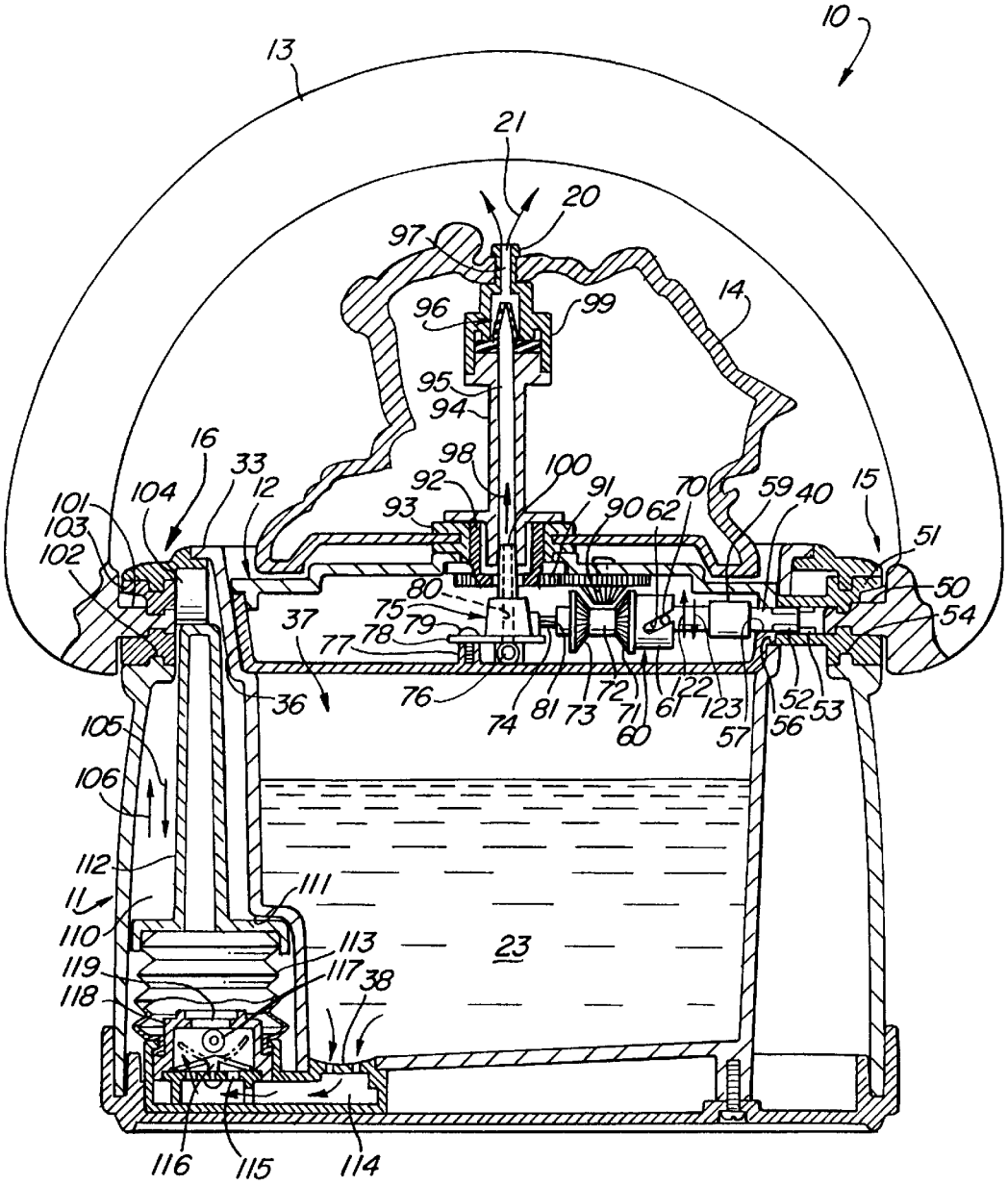
FIG. 3 sets forth a section view of the present invention sprinkler toy taken along section lines 3—3 in FIG. 1.

FIG. 3 sets forth a section view of the present invention sprinkler toy taken along section lines 3—3 in FIG. 1. As described above, sprinkler toy 10 includes a base 11 having a generally cylindrical pail-like shape defining an upper rim 33 supporting an annular cap ring 55. As is also described above, base 11 defines an interior reservoir 37 suitable for receiving and holding a quantity of water 23. A grille 38 defines a plurality of liquid flow apertures and is supported at the low point of reservoir 37. As is also described above, sprinkler toy 10 includes a handle 13 supported on each end thereof in a rotatable pivot attachment 15 and 16. A rotating element 14 is supported upon a cover 12. Cover 12 is secured to base 11 at a hinge 85 (seen in FIG. 4). Cover 12 further includes a seat 36 formed to be received within the upper interior of reservoir 37.

Pivot 15 includes a coupler bearing 51 received within a journal 54 of base 11. A shaft 50 extends into coupler 51 and engages 51 using a conventional splined engagement between coupler 51 and shaft 50. Thus coupler 51 is pivotable within journal 54 directly in response to movements of handle 13. Cap ring 55 provides an exterior support for coupler 51. Coupler 51 further includes an extension 65 extending inwardly and received within aperture 56 in a rotatable support. Extension 65 defines a plurality of spline grooves which receive a splined end shaft 52 of drive coupler 50. Drive coupler 50 is supported within cover 12 and includes an inwardly extending coupler shaft 58. The interior end of coupler shaft 58 is received within a guide housing 61 of a gear carrier 60. Guide housing 61 defines an angled guide 62 and coupler shaft 58 defines a pin 70 received within guide 62. Gear carrier 60 further includes a pair of bevel gears 71 and 73 separated by a spacer shaft 72. A shaft end 54 is received within a bore 81 formed in a bearing 75. Bearing 75 is supported upon a boss 77 formed in cover 12 for receiving one end of a tube 76 in an attachment better seen in FIG. 4. Bearing 75 further defines a vertically extending nozzle 100 having a passage 80 therethrough which communicates entirely through nozzle 100 and the fitting for tube 76.

Rotating element 14 is supported upon cover 12 by a bearing 93. A carrier 92 extends into and is joined to bearing 93. A gear 91 is supported beneath carrier 92 and is preferably integrally formed therewith. A gear 90 is rotatably supported above gears 71 and 73 and forms a compound gear having an outer portion engaging gear 91 and a bevel portion extending downwardly between gears 71 and 73. In accordance with an important aspect of the present invention, the spacing between bevel gears 71 and 73 is somewhat greater than the dimension of the bevel gear portion of compound gear 90. The importance of this dimensional relationship is set forth below in greater detail. However, suffice it to note here that the spacing relationship of gear 90 and gears 71 and 73 allows gear carrier 60 to move left or right in the manner described below to engage either gears 71 or 73 against gear 90.

Rotating element 14 further includes a nozzle housing 99 supported upon bearing 93 by a stem 94 having a passage 95 formed therein. The lower end of stem 94 receives the upper portion of nozzle 100 such that passages 80 and 95 are in communication. The fit between nozzle 100 and passage 95 is preferably loose enough to facilitate the rotation of rotating element 14 in which stem 94 is carried in its rotation by carrier 92 of gear 91 and bearing 93.

Nozzle housing 99 further includes a check valve 96 coupling passage 95 to nozzle 20 having a nozzle passage 97 formed therein.

Pivot 16 includes a coupler 103 rotatably supported within a journal 102. Cap ring 55 secures the upper portion of coupler 103. Handle 13 includes a splined shaft 101 which is engageably received by coupler 103. Thus coupler 103 together with shaft 101 of handle 13 are rotatable within journal 102. Coupler 103 further supports an offset cam 104 which moves up and down in response to pivotal movement of handle 13 about pivots 15 and 16.

Sprinkler toy 10 further includes a pump housing 110 defined within base 11. An elongated pushrod 112 includes an upper end contacting cam 104 and a lower end supported by a pump bellows 113. Pump housing 110 defines a constructed portion forming a stop 111 which captivates pushrod 112 within pump housing 110. Pump bellows comprises a conventional hollow "accordion pleat" bellows formed of a resilient rubber or plastic material.

A plenum 114 communicates with grille 38 and defines a plurality of apertures 115. Apertures 115 cooperate with a check valve 116 which is, in the example shown, fabricated of a soft rubber or plastic material. A housing 118 secured to plenum 114 supports and surrounds check valve 16. Housing 118 defines an aperture 119 communicating with the interior of pump bellows 113. A check valve 117 is also supported within housing 118 and is coupled to a flexible tube (tube 120 seen in FIG. 4). Check valve 117 operates on the output end of the pump formed by pump bellows 113 and cam 104 while check valve 116 controls the input water flow to housing 118 from reservoir 37.

In operation, base 11 is secured to a convenient surface such as a sink top, table top, patio table, or outdoors by a plurality of suction cups such as suction cup 125 shown in FIG. 4. Thereafter in the manner described in FIGS. 1 an 2, cover 12 is opened allowing a quantity of water 23 to be placed within reservoir 37. Once cover 12 is returned to its closed position, the present invention sprinkler toy is ready for operation. As mentioned above, the operating power for sprinkler toy 10 is provided by the angular movement of handle 13 about pivots 15 and 16. As is also mentioned above, handle 13 moves easily in both directions as it is pivoted with respect to base 11. The pivotal movement of handle 13 provided by the user's handling of handle 13 provides two simultaneous activities. The first activity rotates element 14 in the manner described below while the second activity transfers water 23 from within reservoir 37 through a pumping apparatus to spray upwardly and outwardly from nozzle 20.

More specifically with respect to the rotation of rotating element 14, the pivotal movement of handle 13 produces a corresponding pivotal movement of shaft 50 and engaged coupler 51. Coupler 51 is rotatable within journal 54. Extension 65 having splines 53 is engaged with splines 52 of shaft 40. Shaft 40 is spring biased by an extension slider 59 which facilitates the opening and closing of cover 12 by allowing shaft 40 to move inwardly and thereby pass into alignment with extension 65. The back and forth rotation of extension 65 produces a corresponding back and forth rotation of coupler shaft 58. Coupler shaft 58 passes into gear carrier 60 and supports a pin 70. Gear carrier 60 is directly coupled to bevel gears 71 and 73 as well as spacer 72. The cooperation of angled guide 62 formed in gear carrier 60 and pin 70 carried by coupler shaft 58 causes the lateral position of gear carrier 60 to be changed in response to a given direction of rotation of shaft 58. It will be recalled at this point that the movement of handle 13 which is ultimately coupled to shaft 58 is an angular reciprocating or back and forth motion.

Thus during the portion of handle 13 movement in which coupler shaft 58 rotates clockwise in the direction indicated by arrow 122, pin 70, operative within angled guide 62, forces gear carrier 60 to the left engaging gear 71 with gear 90. Thereafter the continued angular movement in the direction of arrow 122 causes gear 90 to rotate which in turn rotates gear 91, carrier 92, bearing 93, and rotating element 14. This rotation continues so long as handle 13 continues to be pivoted about pivot 15 to rotate coupler shaft 58 in the direction indicated by arrow 122.

Conversely, when handle 13 is rotated to the opposite side of base 11, shaft 58 is rotated counterclockwise in the direction indicated by arrow 123. In response, pin 70 cooperates with angled guide 62 to draw gear carrier 60 to the right in FIG. 3 moving gear 71 out of engagement with gear 90 and engaging gear 73. Because gears 71 and 73 engage from opposite sides of gear 90, the opposite direction rotations of each of gears 71 and 73 result in rotation in a single direction of gear 90.

Thus as handle 13 is pivoted back and forth between extremes on each side of base 11, gear carrier 60 engages gear 71 to gear 90 for one half of the cycle and engages gear 73 with gear 90 on the return half of the pivotal movement cycle of handle 13. As a result, and in accordance with an important aspect of the present invention, despite the movement of handle 13 back and forth in two directions, the rotation of rotating element 14 is maintained in a single direction and generally continuous rotation.

With respect to the water spray operation of the present invention, the above-mentioned pivotal movement of handle 13 also causes pivotal movement or rotation of shaft 101 and coupler 103. Because coupler 103 carries cam 104, the pivotal movement of coupler 103 results in movement of offset cam 104 which produces movement of pushrod 20 in the directions indicated by arrows 105 and 106. In the configuration shown in FIG. 3, the resilience of pump bellows 113 is selected to have sufficient strength to act as a return spring which, at the raised position of cam 104 shown in FIG. 3, expands pump bellows 113 to its maximum height. The action of pump bellows 113 essentially involves two cycles. The first cycle occurs when pushrod 112 is driven downwardly in the direction indicated by arrow 105. The result of compression of bellows 113 is the pressurizing of housing 118. Under these circumstances, check valve 116 closes and check valve 117 opens. Thereafter, any water having been present within housing 118 is caused to flow through flexible tube 120 (seen in FIG. 4). This water flow is coupled in the manner shown in FIG. 4 and forced into passage 80 of bearing 75 producing an upward directed flow indicated by arrow 98 through nozzle 100, passage 95, valve 96, and nozzle passage 97 to produce spray 121. Conversely, as cam 104 rises, pushrod 112 rises due to the resilience of pump bellows 113. This rising or expanding of pump bellows 113 provides a reduced pressure or partial vacuum within housing 118. In the presence of such reduced pressure, check valve 117 closes and check valve 116 opens. As check valve 116 opens to expose the reduced pressure within housing 118, water within reservoir 37 is forced downwardly through grille 38 and into housing 118 through apertures 115 passing check valve 116. The cycle is repeated on the next downward movement of cam 104 as bellows 113 is again compressed closing check valve 116 while opening check valve 117 and producing additional pressurized water flow.

Thus as the user repeatedly pivots handle 13 back and forth about base 11, the simultaneous events of rotation of rotating element 14 and water spray from spray nozzle 20 take place.

FIG. 4 sets forth a section view of sprinkler toy 10 taken along section lines 4—4 in FIG. 1. Toy 10 includes a base 11 supporting a cover 12. Base 11 defines a reservoir 37 supporting a quantity of liquid such as water 23. Base 11 further defines an upwardly extending housing 126 which receives end 127 of a suction cup 125. While not seen in FIG. 4, in the preferred embodiment of the present invention, base 11 supports a plurality of housings such as housing 126 which in turn receive the end portions of suction cups substantially identical to suction cup 125. A hinge 85 pivotally couples cover 12 to the rim portion of base 11 and allows cover 12 to pivot thereon to the open position shown in FIG. 2. Within cover 12, a bearing 75 supports a nozzle 100 which extends upwardly through a gear 91. Gear 91 in turn is coupled to bearing 93 which supports rotating element 14. A stem 94 extends downwardly and communicates with nozzle look in the manner shown in FIG. 3. The upper portion of stem 94 supports a nozzle housing 99 which in turn supports nozzle 20.

In further accordance with the present invention, a flexible tube 120 is coupled to check valve 117 of housing 118 (seen in FIG. 3) and extends upwardly to be received within the interior of a pump outlet 34. A fitting 35 is positioned in alignment with pump outlet 34 and is coupled to passage 80 (seen in FIG. 3) of bearing 75 by a flexible tube 76.

Thus as pump bellows 113 is operated in the manner described above, water under pressure is pumped upwardly through tube 120 and pump outlet 34 through fitting 35 and pump 76 to eventually be forced upwardly through bearing 75, nozzle 100, stem 94, housing 99, and outwardly through nozzle 20 to produce the above-described upwardly directly spray.

Suction cup 125 functions in the typical manner of such suction cups and produces an attachment force to an underlying play surface by simply forcing base 11 downwardly upon the surface to be gripped. Suction cup 125 may be released by allowing air to pass into the suction cup breaking its seal and facilitating movement of toy 10.

What has been shown is a sprinkler toy having a water play feature which avoids the need for connection to a source of water such as a garden hose or the like. The sprinkler toy shown has a pail-like bucket forming a base secured with suction cups to the play surface together with a hinged cover which opens to admit water to an internal reservoir in the base. The cover supports a rotating fanciful element and an upwardly directed spray nozzle. With the reservoir filled and the cover closed, a pivotally supported handle is moved back and forth in pivotal movement between each side of the supporting base to cause simultaneous actions of water spray upwardly from the rotating element and rotation of the element. A unique drive mechanism maintains single direction rotation of the rotating element despite bidirectional pivotal motion of the handle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A sprinkler toy comprising:

a base defining a reservoir, for holding a quantity of liquid, and an upper rim;

a handle pivotally supported upon said base, said handle being pivotable from one side of said base to the other;

a cover receivable by said rim having a rotatable element and an upwardly directed nozzle;

a pump having a liquid input within said reservoir, an output, and means coupling said output to said nozzle;

cam means coupled to said handle and pivoting with said handle;

a pump drive operative in response to said cam means cooperating said pump as said handle is pivoted; and drive means, coupling said handle to said rotatable element, said drive means converting bi-directional pivotal motion of said handle to a single direction rotation of said rotatable element.

2. The sprinkler toy set forth in claim 1 wherein said drive means includes:

a first bevel gear coupled to said rotatable element for rotation thereof;

a gear carrier having second and third inwardly facing bevel gears spaced on each side of said first bevel gear;

a shaft coupled to said gear carrier and said handle, said gear carrier having means for sliding in a first direction in response to pivotal movement of said handle in a first direction to engage said first and second bevel gears and said gear carrier sliding in a second direction in response to pivotal movement of said handle in a second direction to engage said first and third bevel gears.

3. The sprinkler toy set forth in claim 2 wherein said means for sliding includes a collar defining an angled guide slot and a pin extending from said shaft into said angled guide slot.

4. The sprinkler toy set forth in claim 3 wherein said pump includes a resilient bellows having a plenum and a pair of oppositely oriented check valves and wherein said pump drive means includes a pushrod having a first end riding said cam and a second end contacting said pump bellows.

5. The sprinkler toy set forth in claim 4 wherein said handle defines a U-shaped member having a first end coupled to said cam means and a second end coupled to said drive means.

6. The sprinkler toy set forth in claim 5 wherein said means coupling said pump output to said nozzle includes a first fitting supported on said base and a first tube coupling said first fitting to said pump output and a second fitting supported on said cover and a second tube coupled between said second fitting and said nozzle, said first and second fittings joining when said cover is closed.

7. The sprinkler toy set forth in claim 1 wherein said pump includes a resilient bellows having a plenum and a pair of oppositely oriented check valves and wherein said pump drive means includes a pushrod having a first end riding said cam and a second end contacting said pump bellows.

8. The sprinkler toy set forth in claim 7 wherein said handle defines a U-shaped member having a first end coupled to said cam means and a second end coupled to said drive means.

* * * * *